US005386919A

United States Patent [19]

Long

[11] Patent Number: 5,386,919

[45] Date of Patent: Feb. 7, 1995

[54] FULLY COLLAPSIBLE BOX WITH REVERSE MITRED CLEATS

[76] Inventor: Rodney W. Long, 1644 Kirby Rd., Lebanon, Ohio 45036

[21] Appl. No.: 65,670

[22] Filed: May 21, 1993

[51] Int. Cl.[6] ..... B65D 19/10

[52] U.S. Cl. ..... 217/36; 217/43 R; 217/43 A; 220/6

[58] Field of Search ..... 217/36, 38, 43, 43 A; 220/4.29, 6

[56] References Cited

U.S. PATENT DOCUMENTS

| | | | |
|---|---|---|---|
| 645,898 | 3/1900 | Fisher | 217/36 |
| 669,728 | 3/1901 | Heagerty . | |
| 910,792 | 9/1909 | Dahl . | |
| 1,845,194 | 2/1932 | Rosemund | 217/36 |
| 2,110,150 | 3/1938 | Hile | 217/43 |
| 2,154,538 | 4/1939 | Stivers . | |
| 2,490,296 | 12/1949 | Fournier | 220/6 X |
| 2,901,141 | 8/1959 | Dedmon . | |
| 3,027,038 | 3/1962 | Kordowski . | |
| 3,080,992 | 3/1963 | Dedmon . | |
| 3,159,300 | 12/1964 | Coffey, Jr. | 217/43 A |
| 3,262,597 | 7/1966 | Coffey, Jr. | 217/43 A |
| 3,323,674 | 6/1967 | Nist, Jr. . | |
| 3,878,795 | 4/1975 | Janda . | |
| 4,277,878 | 7/1981 | O'Neal . | |
| 4,300,694 | 11/1981 | Wait et al. . | |
| 4,650,084 | 3/1987 | Long . | |

*Primary Examiner*—Steven M. Pollard
*Attorney, Agent, or Firm*—Wood, Herron & Evans

[57] ABSTRACT

A fully collapsible box with four sidewalls comprising vertical slats, horizontal cleats and interconnected wires at the ends of the cleats at the corners of the box, wherein the ends of the cleats have reverse miters so that the box may be hingedly collapsed along these corners when not in use. Hinged collapsing of this box does not require disconnection of the wires and does not adversely affect the tightness of the wire interconnections between adjacently located cleats. Because the reverse miters allow the box to be hingedly collapsed while the sidewalls remain interconnected, this invention assures a sturdy box over a period of use, while eliminating the need to connect and disconnect the cleats at the corners of the box during assembly and disassembly, respectively. In one embodiment the wire internconnection comprises a single loop extending completely around the box and secured to the cleats.

7 Claims, 2 Drawing Sheets

FULLY COLLAPSIBLE BOX WITH REVERSE MITRED CLEATS

FIELD OF THE INVENTION

This invention relates generally to containers for cargo or freight and more particularly concerns a container such as a box which can be collapsed when not in use.

BACKGROUND OF THE INVENTION

In transporting cargo of various types, shipping containers of wood, fiber board, or the like are used to hold and protect the cargo. One common type of container is a box having rigid sidewalls, typically constructed of wood, resting upon a pallet and including a cover or lid to complete the enclosure. Once the cargo has reached its destination, the box is dismantled and discarded.

Due to the cost of construction of such rigid containers, collapsible boxes have been produced so that when such a box is not in use it may be collapsed for storage or for return to the point of origination of the cargo for re-use.

Such prior collapsible boxes have taken a number of forms. Some are held together by fairly elaborate arrangements of encircling wires and/or metal bands. These types of collapsible boxes present difficulties in re-assembly and disassembly.

Another common type of shipping box includes four sides, which are substantially vertical when the box is in use, each side having several vertical slats held together by a number of horizontal cleats. The sidewalls either rest upon or are secured to a base or pallet, and a suitable cover or lid may be additionally provided.

In a collapsible box of this type, in one prior construction, the sidewalls are held together at the corners by interlooped wire elements, the ends of which are permanently secured between adjacent cleats and slats. Such a sidewall structure relies for its rigidity upon a rectangular border on the pallet base upon which the walls are positioned. When the four walls are removed from the base, the interlooped connecting elements at the corner are sufficiently loose to permit the sidewalls to collapse into a flattened condition. In the collapsed condition of this type of box, the sidewalls are not disconnected from one another since the interlooped wire elements are permanently secured to the sidewalls. Unfortunately, due to some looseness in the connecting elements, which is necessary to allow the box to collapse, this box is not very sturdy after more than one use, particularly when shipping contents for which no lid is required.

In another collapsible box having sidewalls of the same general type as that described above, holes are drilled through the cleats which are adjacent one another at each of the corners of the box. Then, to releasably secure the sidewalls together, a single wire loop element is passed through the bores through the cleats, with the ends of the wire element then twisted together. This type of attachment of the collapsible box sidewalls, while permitting disassembly of the walls from one another, also fails to provide a particularly rigid connection for the sidewalls.

Long U.S. Pat. No. 4,650,084 discloses a collapsible box with sidewalls that may be secured together in a manner that they may be readily disassembled from one another and yet, when assembled, provide a relatively rigid and sturdy structure. This is accomplished via loop elements with tapered nails which permanently connect to the cleats and tie means for releasably securing adjoining loop elements at the corners of the box.

The Long invention facilitates assembly and disassembly of the walls of a collapsible box. Nevertheless, the assembly and disassembly of this particular box, and others, requires excessive labor and time because it is still necessary to tie and untie the cleats at the corners every time the box is assembled or disassembled, respectively.

It is an objective of this invention to further facilitate the assembly and disassembly of a collapsible box used in shipping cargo.

It is another objective of this invention to reduce the labor required to assemble and disassemble a collapsible box.

It is still another objective of the invention to maintain a high degree of rigidity for a collapsible box that is easy to assemble and disassemble.

The above-stated objectives are achieved by a collapsible box designed to allow the sidewalls to remain interconnected when fully collapsed and not in use but with the connecting elements sufficiently tight to maintain structural rigidity over a number of uses. Because this box is fully collapsible with the walls remaining interconnected, this box eliminates the need to interconnect and disconnect the cleats at the corners of the box every time the box is assembled or disassembled. Nevertheless, because this invention employs the connecting elements and the tie means of the above-identified Long patent, the rigidity of the box can be assured by periodically retightening the tie means between each set of interconnecting connector elements.

This invention contemplates the use of cleats having ends with reverse miters at the corners of the box. With reverse miter cleats located at least at two diagonally opposing corners of a collapsible box, the interconnected walls may be fully collapsed together during periods of non-use, with the connecting elements remaining relatively tight to assure structural rigidity for the box.

According to a preferred embodiment of the invention, a fully collapsible box comprises four sidewalls of vertical slats secured together by horizontal cleats which are interconnected to the cleats of adjacent sidewalls, at the corners, by interconnecting wire loops, wherein the loops remain connected to the cleats and the adjoining loops are tied together by tie means of the type disclosed in the above-identified Long patent. For at least two diagonally opposing corners of the box, the cleats have reverse miterd corners to allow the box to be collapsibly hinged while all four sidewalls remain tightly interconnected. The reverse miters allow the box to be relatively easily collapsed without significantly affecting the tightness of the interconnected loops. Periodically, the connected loops may be retightened, if necessary.

According to one alternative embodiment, a single continuous wire loop extends all the way around the box and is held in place by staples. Use of a single loop eliminates any loosening of the interconnections at the corners which eventually form the two ends of the collapsed box, because the tension generated at these corners is offset by the slack generated in the wire at the other two diagonally opposing corners.

These and other features of this invention will be more readily understood in view of the following detailed description of the drawings.

DETAILED DESCRIPTION OF THE DRAWINGS

Figure 1:
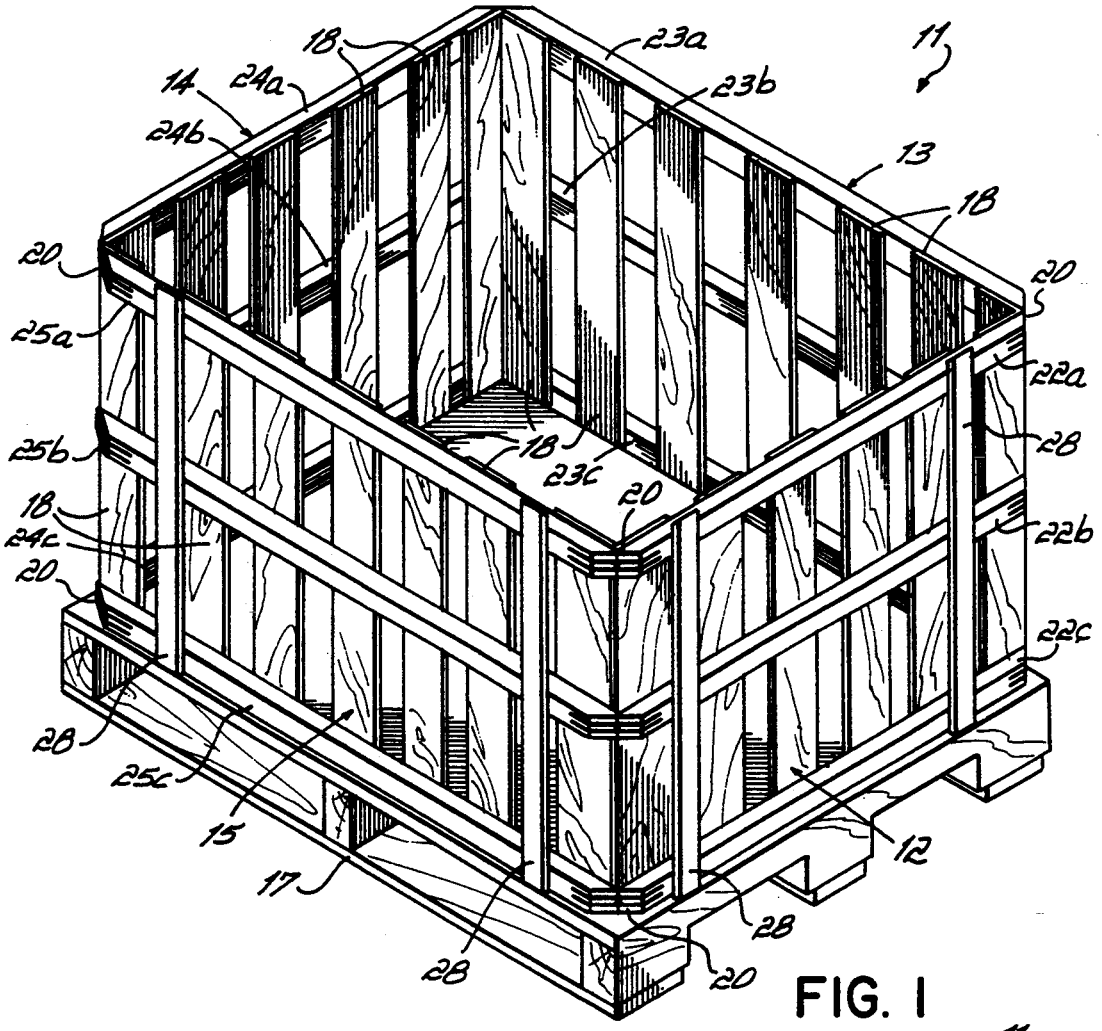
FIG. 1 is a perspective view of a collapsible box constructed in accordance with the present invention.

While the invention is susceptible to various modifications and alternative forms, certain illustrative embodiments have been shown by way of example in the drawings and will herein be described in detail. It should be understood, however, that it is not intended to limit the invention to the particular form disclosed. On the contrary, the intention is to cover all modifications, equivalents and alternatives falling within the spirit and scope of the invention as defined by the appended claims.

With reference to FIG. 1, a collapsible box 11 includes four vertical sides 12, 13, 14 and 15. The four vertical sidewalls are mounted on a pallet base 17 which forms a bottom of the collapsible box 11. While the illustrated box 11 includes the four sides 12–15 and the base 17, and has no cover or lid, other forms of collapsible boxes embodying the invention are also contemplated. For example, for some applications, the collapsible box 11 may include only the sidewalls 12, 13, 14 and 15, while in other situations the box 11 may include both a base 17 and a lid (not shown).

Each sidewall of the box 11 includes a number of vertical slats 18. The slats 18 of the sidewalls 12, 13, 14 and 15 are secured together by horizontal cleats 22, 23, 24 and 25, respectively. For example, the sidewall 12 includes vertical slats 18 and three horizontal cleats, identified as 22*a*, 22*b* and 22*c*. Similarly, cleats 23*a*, 23*b* and 23*c* secure the slats 18 of wall 13, and so on. Preferably, as shown in the Figures, each corner defined by the four sides 12–15 of the collapsible box 11 includes a pair of adjacently located corner slats 18 which are not secured together.

FIG. 1 also shows vertical posts 28 which extend upwardly from the pallet base 17. The posts 28 may also be secured to the slats 18, if desired. Some combination of pallet base 17, a lid (not shown) and/or posts 28 of this type are generally required to maintain the box 11 in a rectangular configuration.

Each cleat 22, 25 has two ends, the ends located at the corners of the box 11. For at least two corners, the ends of the cleats have reverse miters 20 cut therein, as shown by reference numeral 20.

Figure 2A:
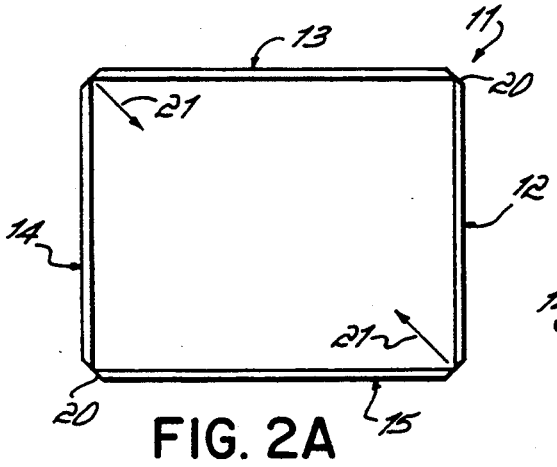
FIGS. 2A, 2B and 2C are schematics which sequentially depict collapsing of a collapsible box constructed in accordance with the invention.
Figure 2B:
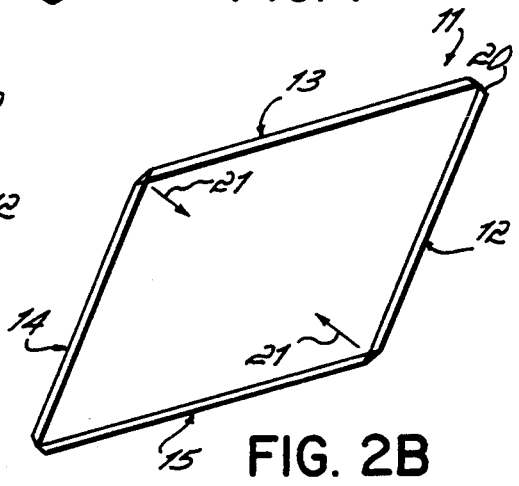
Figure 2C:
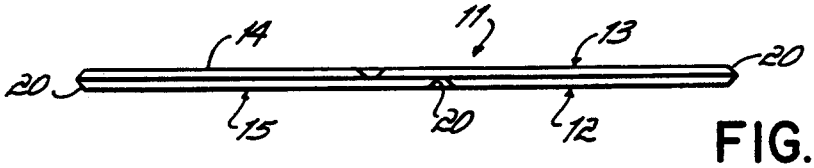

The reverse miters 20 allow the box 11 to be hingedly collapsed during periods of non-use, as shown diagrammatically in FIGS. 2A, 2B and 2C by directional arrows 21. Collapsing the box 11 does not significantly adversely affect the tightness of the interconnections between adjoining cleats.

Figure 3:
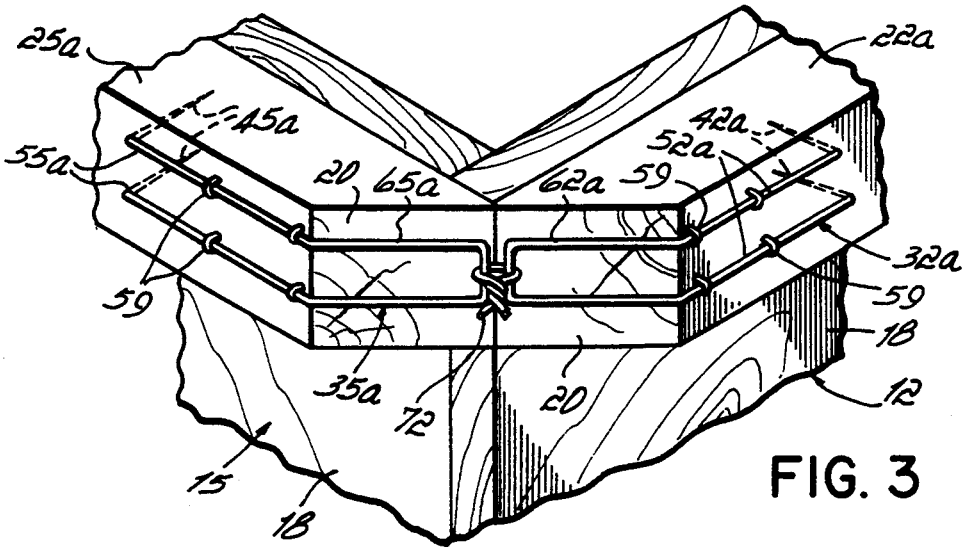
FIG. 3 is a partial perspective view of one corner of the collapsible box depicted in FIG. 1.

FIG. 3 shows interconnected wire loops used to interconnect adjoining cleats 22*a* and 25*a*. This interconnection and other suitable wire interconnections are disclosed in Long U.S. Pat. No. 4,650,084, which is expressly incorporated by reference herein, in its entirety. More specifically, in order to secure cleats 22*a* and 25*a*, a first loop element 32*a* is secured to the cleat 22*a*, and a second loop element 35*a* is secured to the cleat 25*a*. The two loop elements 32*a* and 35*a* are then releasably fastened together about midway between the ends of cleats 22*a* and 25*a*, respectively, at the corner of the box 11. As shown clearly in FIG. 3, and in FIGS. 4 and 5 for that matter, the structural components which interconnect adjoining cleats are located at the outer periphery of the rectangular configuration defined by the box 11, or primarily around the outside of the external surfaces of the cleats. These structural components do not contact the slats 18.

To secure the loop element 32*a* to the cleat 22*a*, the loop element 32*a* includes a pair of tapered end portions 42*a* which are driven into the cleat 22*a*. Each cleat has two loop elements of this type, one at each end. A pair of elongated portions 52*a* of the loop element 32*a* extend along the cleat 21*a* to the end of the cleat 22*a*, at the corner of the box 11. The two elongated portions 52*a* terminate in a loop portion 62*a* at the corner of the box 11. The elongated portions 52*a* of the loop element 32*a* are further secured to the cleat 21*a* by staples 59. The staples 59 are preferably applied utilizing a staple gun having a slotted head to accommodate the elongated portions 52*a* of the loop elements 32*a*.

The loop element 35*a* is secured to the cleat 25*a* in the same fashion that the loop element 32*a* is secured to the cleat 22*a*, and consequently the mode of attachment shall not be described in detail. The loop element 32*a* terminates in a loop portion 65*a* at the corner of the box 11 adjacent the loop portion 62*a* of the loop element 32*a*. In order to fasten the two loop elements 32*a* and 33*a* together, a wire 72 is passed through the loop portions 62*a* and 65*a*, and the free ends of the wire 72 are twisted together to tighten the wire 72.

Tightening the wire 72 draws the two loop elements 32*a* and 35*a* more tightly together and bends the elongated portions of the loop elements at the corners of the cleats 22*a* and 25*a* respectively, drawing the loop portions 62*a* and 65*a* of the loop elements 32*a* and 35*a* inwardly toward the box 11. In this way, the resultant force pulling the loop elements together is not only directed along the cleats, tending to pull them toward the corner, but also inwardly as the loop portions are drawn inwardly by the tightening of the wire 72. During collapsing, the ends of the loops tend to elongate.

Figure 4:
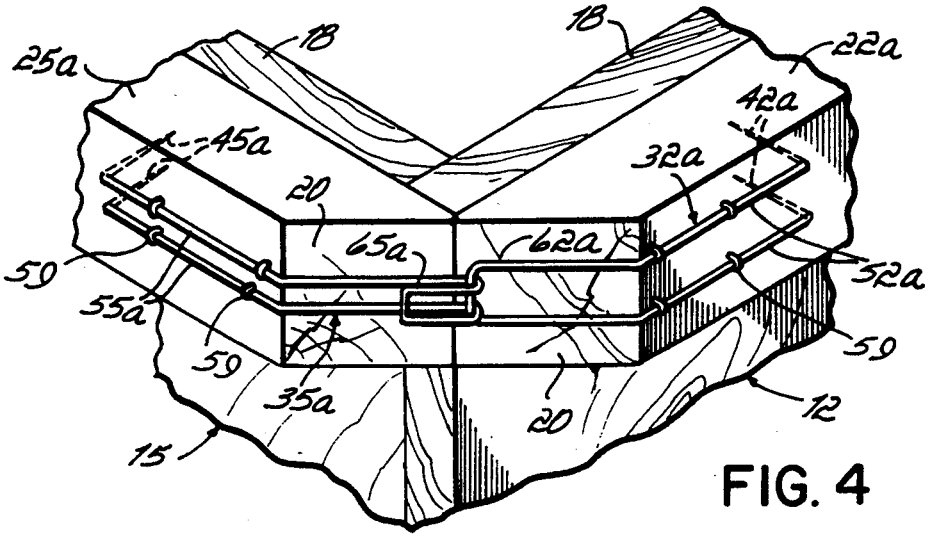
FIG. 4 is a partial perspective view of a corner of a collapsible box constructed in accordance with the invention, similar to FIG. 3, but depicting an alternative manner of interconnecting the wire loops of adjacently located cleats.

With reference to FIG. 4, an alternative interconnection arrangement for the loop elements holding the collapsible box 11 together dispenses with the use of a wire to hold two loop elements together. As shown in FIG. 4, the loop element 32*a* is secured to the cleat 22*a* in substantially the same manner as illustrated in FIG. 3. To connect the cleat 22*a* to the cleat 25*a*, a second loop element 35*a* is secured to the cleat 25*a* and includes an elongated loop portion 65*a* of sufficient length to extend past the corner of the box 11. The loop element 65*a* is secured to the cleat 25*a* in the same manner as the loop element 32*a* is secured to the cleat 22*a*. That is, the loop element 35*a* includes a pair of tapered ends 45*a* driven into the cleat 25*a* and a pair of elongated portions 55*a* secured to the cleat 25*a* by staples 59.

In order to fasten the two loop elements 32*a* and 35*a* together, the loop portion 65*a* of the loop element 35*a* is inserted through the loop portion 62*a* of the loop element 32*a* and then bent back upon itself, tightening the two loop elements together. In tightening the two loop elements together, the force-bearing points between the two loop elements are drawn inwardly toward the box 11. This provides an inward direction to the securing force, as is produced in the interconnection arrangement shown in FIG. 1. Again, during collapsing, the loops may elongate somewhat.

While FIGS. 3 and 4 show two adjoining cleats at one of the corners of the box 11, it is to be understood that all of the adjoining cleats at this corner of the box 11 also have reverse miters 20 cut into their ends. Moreover, all of the cleats at a diagonally opposite corner also have reverse miters 20 cut therein. Thus, it is only necessary to cut reverse miters 20 into the ends of the cleats for two diagonally opposite corners of the box 11, although the reverse miters 20 may be used at all four corners of the box 11, thereby to provide extra versability in collapsing the box 11.

In use, once the sidewalls 12–15 of box 11 are interconnected, they may remain interconnected while the box 11 is hingedly collapsed during non-use and when the box 11 is held in rectangular configuration for shipping cargo. Because the reverse miters 20 allow the box 11 to remain interconnected in a manner which does not signficantly adversely affect the tightness of the interconnections, this invention assures a sturdy box 11 for a long period of use. Moreover, it is relatively easy to periodically tighten the interconnections between the wire loops, if necessary.

Figure 5:
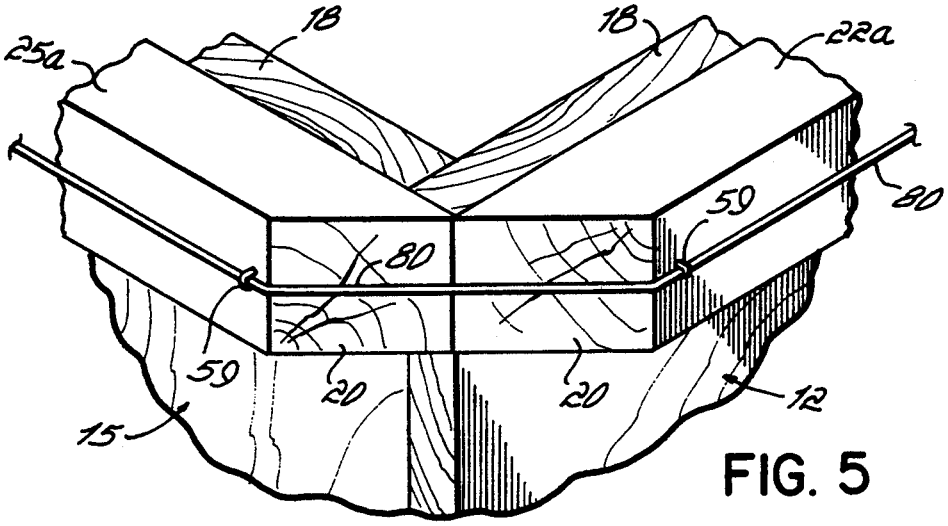
FIG. 5 is a partial perspective view of one corner of a collapsible box constructed in accordance with the invention, similar to FIGS. 3 and 4, but depicting yet another alternative embodiment for interconnecting the cleats.

FIG. 5 shows an alternative embodiment which eliminates the need for retightening any wire connecting elements. FIG. 5 shows a single continuous wire 80 which is looped around the box 11 at one horizontal level and then secured to the four cleats at that level by staples 59. The staples 59 provide enough clearance to allow horizontal movement of the wire 80 therethrough. Thus, when collapsing the box 11, tension at the widest or furthest corners is offset, or relieved, by the slack generated at the two other opposing corners.

While only certain illustrative embodiments of the present invention have been described, those persons skilled in the art to which the invention pertains will readily appreciate that numerous changes and modifications may be made without departing from the spirit of the invention. For example, the precise construction of the sidewalls is not critical to the invention so that certain details such as the number of slats or the presence or absence of spacing therebetween, or the provision of additional bracing boards or cleats would not affect the practice of the present invention.

What is claimed is:

1. A collapsible box comprising four substantially vertical sidewalls meeting at four corners when the sidewalls are arranged in a rectangular configuration;

each sidewall including a plurality of vertical slats and a plurality of generally horizontally disposed cleats vertically spaced along each of the sidewalls, each of the cleats having ends located at the corners, the walls further including at least two pairs of corner slats, each pair of corner slats located at one of a first pair of diagonally opposite corners, each said pair of corner slats including two adjacently located slats partially defining the respective corner; and means for tightly interconnecting the adjacent ends of cleats of adjacently located sidewalls at each of the corners;

wherein the ends of the cleats located at said first diagonally opposite corners of the rectangular configuration have reverse outwardly facing miters lying in a common verticle plane when in an erected position and the corner slats at each of said first pair of diagonally opposite corners are not secured directly together, whereby the sidewalls may be hingedly collapsed with the adjacent cleat ends remaining interconnected at each of the four corners without adversely affecting the tightness of interconnection between adjacently located cleats.

2. The collapsible box of claim 1 wherein each of the cleats has reverse miters at each of its ends so that the box may be hingedly collapsed along either of two separate pairs of diagonally opposing corners.

3. The collapsible box of claim 1 and further comprising:

a pallet base for supporting the four sidewalls in a rectangular configuration.

4. The collapsible box of claim 3 and further comprising:

a plurality of vertical posts extending upwardly from the pallet base to maintain the box in a rectangular configuration.

5. The collapsible box of claim 1 wherein the interconnecting means further comprises:

a single wire loop extending completely around the box, the wire loop secured to the outside of four cleats.

6. A collapsible box comprising four substantially vertical sidewalls meeting at four corners when the sidewalls are arranged in a rectangular configuration;

each sidewall including a plurality of vertical slats and a plurality of generally horizontally disposed cleats vertically spaced along each of the sidewalls and external to the slats, each of the cleats having ends located at the corners, said ends having reverse outwardly facing miters, adjacent cleat ends lying in a common verticle plane when in an erected position; and means for tightly interconnecting the adjacent ends of the cleats of adjacently located sidewalls at each of the corners, said interconnecting means located at the outer periphery of the rectangular configuration and not in contact with the slats; and means for hingedly collapsing the box sidewalls along two diagonally opposing corners in a manner which does not adversely affect the tightness of the interconnection of the cleats, whereby the sidewalls may be hingedly collapsed with the adjacent cleat ends remaining tightly interconnected at each of the four corners.

7. The collapsible box of claim 6 wherein the interconnecting means further comprises:

a single wire loop extending completely around the box, the wire loop secured to the outside of four cleats.

* * * * *